US007152817B2

(12) United States Patent
Wilson et al.

(10) Patent No.: US 7,152,817 B2
(45) Date of Patent: Dec. 26, 2006

(54) ELECTROSTATIC SPRAY DEVICE

(75) Inventors: David Edward Wilson, Reisterstown, MD (US); Bryan Michael Kadlubowski, Manchester, MD (US); Jeffrey Keith Leppla, Baltimore, MD (US); Wataru Hirose, Kyoto (JP); Yoshihiro Wakiyama, Uji (JP); Takeshi Aoyama, Uji (JP); Takeshi Mori, Uji (JP); Toru Sumiyoshi, Ashiya (JP); Joseph Michael Crowley, Morgan Hill, CA (US)

(73) Assignee: The Procter & Gamble Company, Cincinnati, OH (US)

( * ) Notice: Subject to any disclaimer, the term of this patent is extended or adjusted under 35 U.S.C. 154(b) by 856 days.

(21) Appl. No.: 09/759,551

(22) Filed: Jan. 12, 2001

(65) Prior Publication Data

US 2001/0038047 A1 Nov. 8, 2001

Related U.S. Application Data

(63) Continuation-in-part of application No. 09/377,332, filed on Aug. 18, 1999, now Pat. No. 6,318,647, and a continuation-in-part of application No. 09/377,333, filed on Aug. 18, 1999, now Pat. No. 6,311,903.

(51) Int. Cl.
*B05B 5/00* (2006.01)

(52) U.S. Cl. ..... 239/690; 239/692; 239/704; 239/706; 239/708

(58) Field of Classification Search ..... 239/690, 239/690.1, 692, 704, 706, 708, 319, 320, 239/324, 329, 331, 332
See application file for complete search history.

(56) References Cited

U.S. PATENT DOCUMENTS

| | | | |
|---|---|---|---|
| 2,159,894 | A | 5/1939 | Hines |
| 2,629,516 | A | 2/1953 | Badham |
| 3,012,969 | A | 12/1961 | van der Minne et al. |
| 4,000,443 | A | 12/1976 | Lever |
| 4,079,894 | A | 3/1978 | Harjar et al. |
| 4,122,845 | A | 10/1978 | Stouffer et al. |
| 4,143,819 | A | 3/1979 | Hastings |
| 4,194,696 | A | 3/1980 | Harjar |
| 4,258,073 | A | 3/1981 | Payne |
| 4,331,298 | A | 5/1982 | Bentley et al. |
| 4,549,243 | A | 10/1985 | Owen et al. |

(Continued)

FOREIGN PATENT DOCUMENTS

| | | |
|---|---|---|
| BE | 868443 | 12/1978 |
| BE | 882449 | 7/1980 |

(Continued)

*Primary Examiner*—Dinh Q. Nguyen
(74) *Attorney, Agent, or Firm*—Vladimir Vitenberg; Jack Oney; Dara Kendall

(57) ABSTRACT

An electrostatic spray device and a cartridge for an electrostatic spray device that reduce the occurrence of electrically induced emulsion product separation are disclosed. The device and/or the cartridge may reduce electrically induced emulsion product separation by providing a conductive high voltage shield substantially around the product reservoir. Alternatively, the device and/or the cartridge may prevent the product located at the charging location from being in fluid communication with the product reservoir so that the product that is being charged cannot flow back into the product reservoir. The device and/or cartridge may alternatively reduce electrically induced emulsion product separation by minimizing the volume of product between the charging location and the exit orifice of the nozzle.

11 Claims, 11 Drawing Sheets

Fig. 2

U.S. PATENT DOCUMENTS

| | | | | | |
|---|---|---|---|---|---|
| 4,561,037 | A | | 12/1985 | MacLaine et al. | |
| 4,577,803 | A | | 3/1986 | Owen | |
| 4,634,057 | A | * | 1/1987 | Coffee et al. | 239/690 |
| 4,907,727 | A | | 3/1990 | Ernst et al. | |
| 5,105,984 | A | | 4/1992 | Kazimir | |
| 5,221,050 | A | | 6/1993 | Jeffries et al. | |
| 5,222,663 | A | | 6/1993 | Noakes et al. | |
| 5,229,105 | A | | 7/1993 | Wilmsmann | |
| 5,268,166 | A | | 12/1993 | Barnett et al. | |
| 5,292,067 | A | * | 3/1994 | Jeffries et al. | 239/3 |
| 5,296,681 | A | | 3/1994 | Tschauder | |
| 5,322,684 | A | | 6/1994 | Barnett et al. | |
| 5,405,090 | A | | 4/1995 | Greene et al. | |
| 5,422,630 | A | | 6/1995 | Quinn et al. | |
| 5,468,488 | A | | 11/1995 | Wahi | |
| 5,490,633 | A | | 2/1996 | Jeffries et al. | |
| 5,494,674 | A | | 2/1996 | Barnett et al. | |
| 5,519,159 | A | | 5/1996 | Narabe et al. | |
| 5,531,384 | A | | 7/1996 | Greene et al. | |
| 5,566,042 | A | | 10/1996 | Perkins et al. | |
| 5,662,890 | A | | 9/1997 | Punto et al. | |
| 5,674,481 | A | | 10/1997 | Wahi | |
| 5,732,884 | A | | 3/1998 | Jauner | |

FOREIGN PATENT DOCUMENTS

| | | | |
|---|---|---|---|
| BE | 882450 | | 7/1980 |
| DE | 29910321 | | 5/1999 |
| EP | 0 057 324 | A | 8/1982 |
| EP | 096 731 | A1 | 12/1983 |
| EP | 523 960 | A1 | 1/1993 |
| EP | 523 961 | A1 | 1/1993 |
| EP | 523 962 | A1 | 1/1993 |
| EP | 523 963 | A1 | 1/1993 |
| EP | 523 964 | A1 | 1/1993 |
| EP | 544 158 | | 6/1993 |
| FR | 2127433 | | 9/1972 |
| GB | 2 128 900 | A | 5/1984 |
| GB | 2 273 673 | A | 6/1994 |
| GB | 2 273 872 | A | 7/1994 |
| JP | 10-146216 | | 6/1998 |
| SU | 867927 | | 9/1981 |
| WO | 94/11119 | | 5/1994 |
| WO | 94/27560 | | 12/1994 |
| WO | 95/29758 | | 11/1995 |
| WO | 96/10459 | | 4/1996 |
| WO | 96/11062 | | 4/1996 |
| WO | 96/40441 | | 12/1996 |
| WO | 97/33527 | | 9/1997 |
| WO | WO 98/18561 | A | 5/1998 |
| WO | 98/18561 | | 5/1998 |

* cited by examiner

ELECTROSTATIC SPRAY DEVICE

CROSS-REFERENCE TO RELATED APPLICATION

This application is a continuation-in-part of our earlier applications, U.S. Ser. No. 09/377,332 filed on Aug. 18, 1999, now U.S. Pat No. 6,318,647, and U.S. Ser. No. 09/377,333, filed on Aug. 18, 1999, now U.S. Pat No. 6,311,903.

THE FIELD OF THE INVENTION

The present invention relates to a portable electrostatic spray device designed for personal use. More particularly, this invention is focused on providing improvements to both the electronic circuit and mechanical designs that lead to the reduction/elimination of current induced product separation.

BACKGROUND OF THE INVENTION

U.S. Pat. No. 4,549,243 issued to Owen (the "Owen reference") describes a spraying apparatus that can be held in the human hand for applications such as graphic work where it is desired that the area to which the spray is applied can be precisely controlled (Col 1, 11 5–9). The device disclosed in the Owen reference includes a reservoir that may comprise a cartridge, which may be refillable, which can be disconnected from the body member so that the reservoir can be replaced (Col 3, 11 49–52). The Owen reference discloses that the body member is provided with a contact to apply the high potential from the high voltage generator (which may be within the body member or remote therefrom) to the cartridge. If the cartridge is made of an electrically conductive material, then the high potential is conducted either directly to the nozzle or through the cartridge walls to the liquid therein and thence, by conduction through the liquid, to the nozzle (Col 4, 11 35–43). Thus, in the device of the Owen reference, electrical current is passed through the product reservoir or having the high voltage applied directly at the nozzle. Product emulsions, however, are susceptible to electrically induced separation in which the components of the product emulsion may separate. This invention will also not work in devices where high voltage is applied directly at the nozzle which would present a significant shocking hazard.

Published patent application no. GB 1996009622623 of Prenderdgast (the "Prendergast reference") presents an electrostatic spraying device which may be used for air freshening and air purification and is capable of efficiently delivering material in small amounts and/or in a relative short duration of time (p 1, 11 1–8). The electrostatic spraying device disclosed in the Prenderdgast reference includes a delivery system that provides a means for establishing a column of product to be sprayed within a passage such that the trailing surface of the column is separated from the remainder of the material in the reservoir whereby the gap affords electrical isolation between the tip of the nozzle and reservoir (p. 6, 11 10–15). The Prendergast reference recognizes the benefit of such a system as permitting the reservoir to be earthed if desired and the part of the device housing the reservoir may be held in the hand without necessarily having to insulate the user from the material in the reservoir. Such electrical isolation of the main body of material to be sprayed from the column or slug to which voltage is applied may be particularly advantageous since the capacitance of the device during spraying can be reduced significantly (p.6, 11 17–24). The Prendergast reference, however, does not acknowledge the prevention of passing electric current, even at very small reservoirs through the product reservoir.

SUMMARY OF THE INVENTION

The present invention is directed to an electrostatic spray device and/or a cartridge for an electrostatic spray device that reduces the occurrence of electrically induced emulsion product separation. The device and/or the cartridge may reduce electrically induced emulsion product separation by providing a conductive high voltage shield substantially around the product reservoir. Alternatively, the device and/or the cartridge may prevent the product located at the charging location from being in fluid communication with the product reservoir so that the product that is being charged cannot flow back into the product reservoir. The device and/or cartridge may alternatively reduce electrically induced emulsion product separation by minimizing the volume of product between the charging location and the exit orifice of the nozzle.

BRIEF DESCRIPTION OF THE DRAWINGS

While the specification concludes with claims particularly pointing out and distinctly claiming the present invention it is believed that the same will be better understood from the following description, taken in conjunction with the accompanying drawings, in which:

DETAILED DESCRIPTION OF THE PREFERRED EMBODIMENT

A first step in the design of a typical electrostatic spray device starts with identifying the target spray quality for a particular product or application. "Target spray quality" is defined as the combination of one or more of the following: spray droplet diameter, distribution of spray droplet diameter, swath width, and spray diameter. In any particular application, a combination of one, more than one, or all of the above mentioned variables may be needed to define a target spray quality for that application.

To achieve a target spray quality, the output operating variables of the device (e.g. high voltage output, current output, product flow rate) are balanced with a unique set of fluid or product properties (e.g. viscosity, resistivity, surface tension). For a given set of environmental (e.g. temperature, humidity), device operating variables, and fluid properties, a particular charge-to-mass ratio exists for a specific target spray quality. The charge-to-mass ratio is a measure of the amount of electrical charge carried by the atomized spray on a per weight basis and may be expressed in terms of coulombs per kilogram (C/kg). The charge-to-mass ratio provides a useful measure to ensure that the target spray quality is maintained. A change during spraying in any of the fluid properties or device output operating variables will result in a change in the spray quality. This change in spray quality corresponds to a change in the charge-to-mass ratio.

Figure 1:
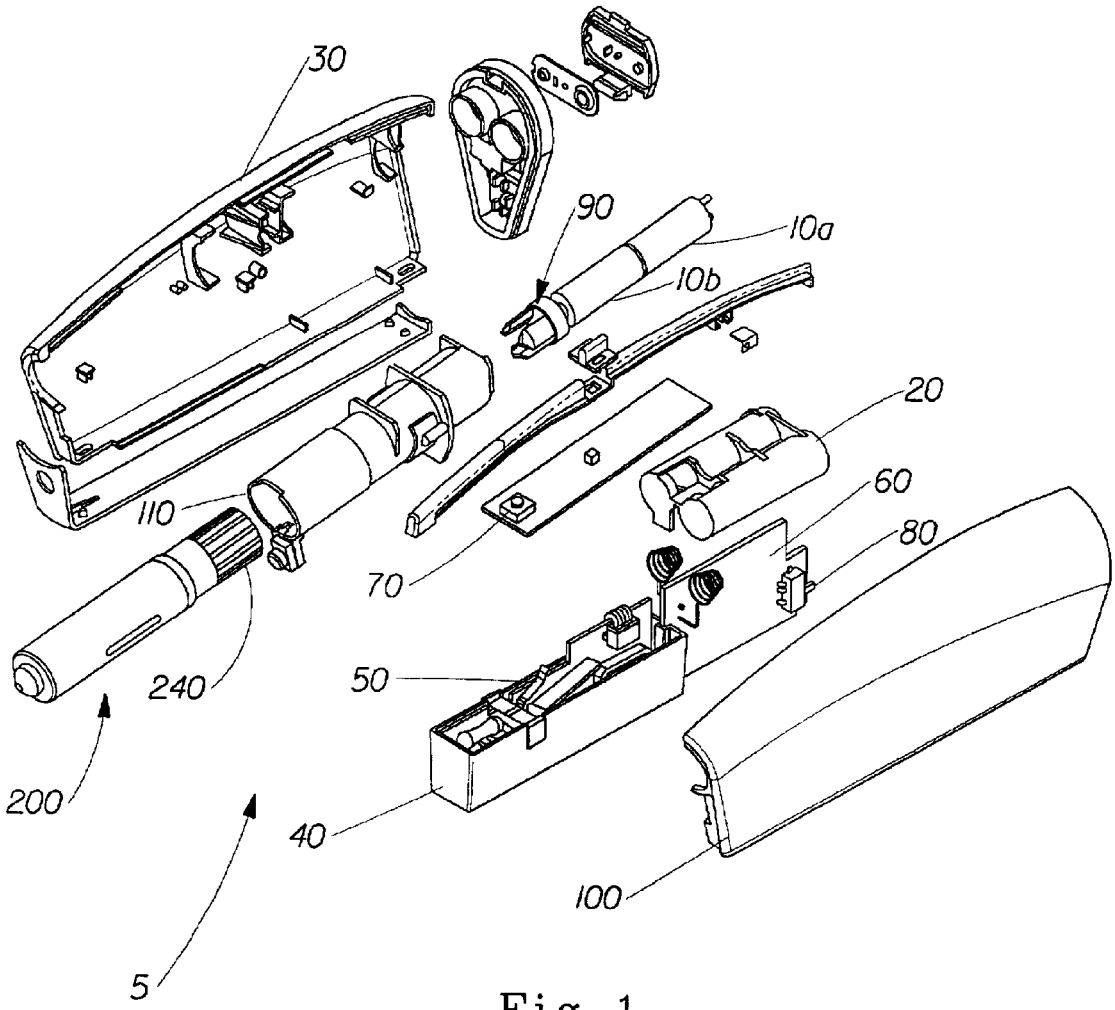
FIG. 1 is an exploded isometric view of a hand-held, self-contained electrostatic spraying device having a disposable cartridge.
Figure 2:
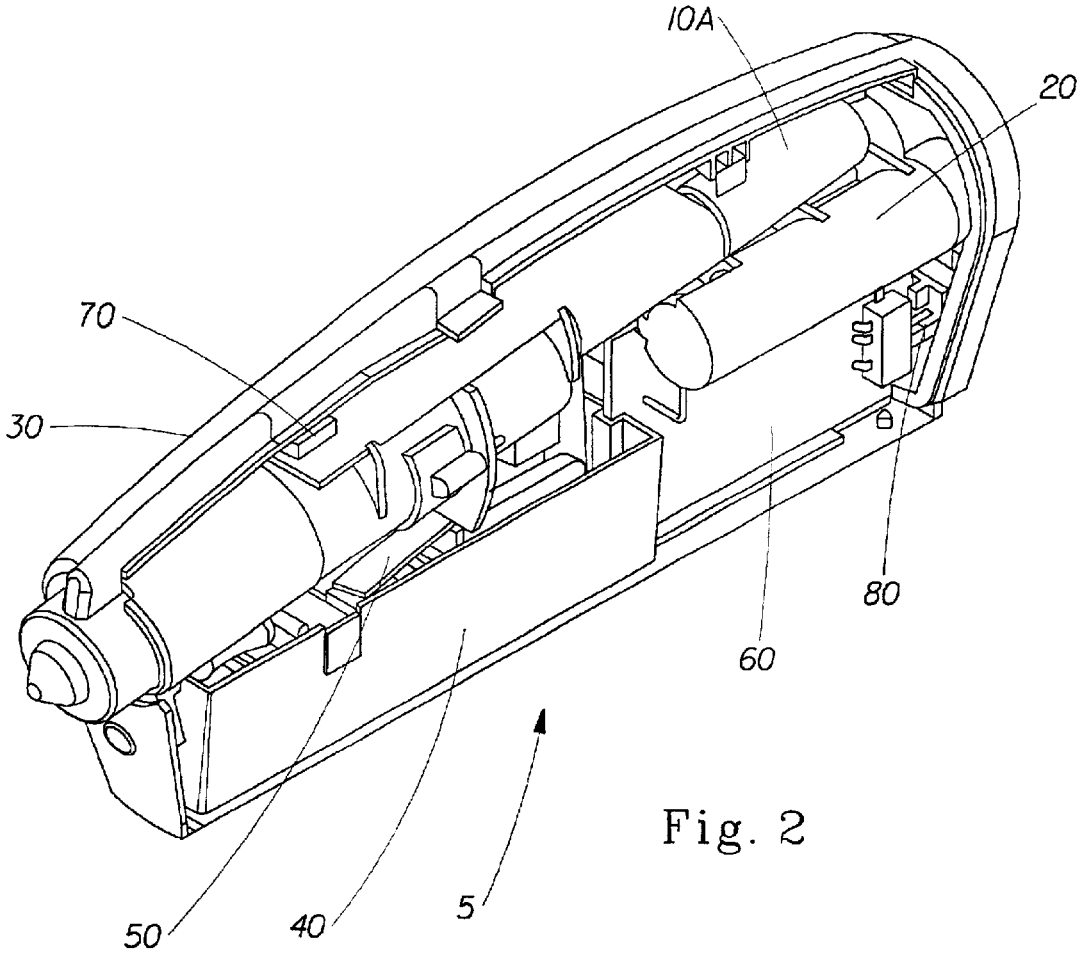
FIG. 2 is an assembled isometric view of the device within FIG. 1.

FIGS. 1 and 2 show a hand-held, self-contained electrostatic spraying device 5 having a disposable cartridge 200. Disposable cartridge 200 may contain a variety of product, including but not limited to, cosmetics, skin creams, and skin lotions. The product in the disposable cartridge 200 may be positively displaced as described below and powered by the gearbox/motor component 10. The gearbox/motor component 10 may be fixed onto a left or first housing 30. The gearbox/motor component 10 can be affixed into place mechanically, adhesively, or by any other suitable technique. The gearbox/motor component 10 can comprise a precision motor 10*a* connected to a gearbox 10*b*. The power source 20 provides power to the motor 10*a* and the high voltage electrode of the cartridge 200. An example of a suitable power source 20 includes, but is not limited to, two "AAA" type batteries. The power source 20 provides power through the control circuit 60 to the high voltage power supply 40, and then to high voltage contact 50, which contacts the disposable cartridge 200. As described below, the high voltage power supply 40 is powered and controlled by control circuit 60. The power-on switch 80 permits the user to interrupt the electrical connection between the power source 20 and the control circuit 60. The power-on switch 80 allows voltage to be supplied to the remainder of the circuit only when the switch 80 is in the "ON" or closed position. Apply switch 70 permits the user to selectively activate motor 10*a*, thereby activating the delivery and spraying of the product. Gearbox/motor component 10 has a driver 90 fastened to a shaft of gearbox 10*b*, for example, with a set screw. Driver 90 has a number of protruding fingers, for example, three, which can fit into the matching recesses on the back of actuator 240.

A first aspect of this invention is providing a method of reducing the electric field gradients and in turn preventing electrical current from flowing through the product reservoir. A reduction in electric field gradients can be accomplished by incorporating a high voltage shield to stabilize the area surrounding the fluid reservoir and to prevent current leakage from the product reservoir to adjacent locations within the device at lower electrical potentials. Without being limited to theory, it is believed that when a product emulsion having conductive and non-conductive phases is stored within a product reservoir, high electric field gradients from within the product reservoir can cause electrical current to flow through the product and cause the product to separate into its conductive and non-conductive phases. It has also been observed that it can be difficult to re-emulsify or remix the product to the quality of the original product design after it has been subjected to an electrically induced separation. The electrically induced separation of the product can change one or more of the fluid properties of the product, e.g., viscosity, resistivity, surface tension, and therefore can change the charge-to-mass ratio of the resulting spray. The change in the charge-to-mass ratio affects the spray formation and may prevent a target spray quality from being achieved. In addition, voltages in the range of 13–15 kV can arc across distances of about 6–10 mm or less, unless heavily insulated. As a result, current can flow through the spray medium from the charging point into the product reservoir and out to an adjacent object at a lower electrical potential such as a circuit ground or a user's hand through corona leakage. In one embodiment of the present invention, a conductive shield may be placed around the product reservoir and may be charged to the same potential as the charging electrode located at the charging location in order to control the electrical currents through and around the spray medium. The shield can provide a high voltage potential around the reservoir and, thus, reduce or eliminate the risk of current passing through the product in the reservoir from the electrode to an object at a lower electrical potential in the vicinity of the reservoir. Rather, current flow resulting from corona leakage or spark discharge will preferentially flow through the less resistive high voltage shield, thereby reducing or eliminating current flow through the product reservoir.

Figure 3:
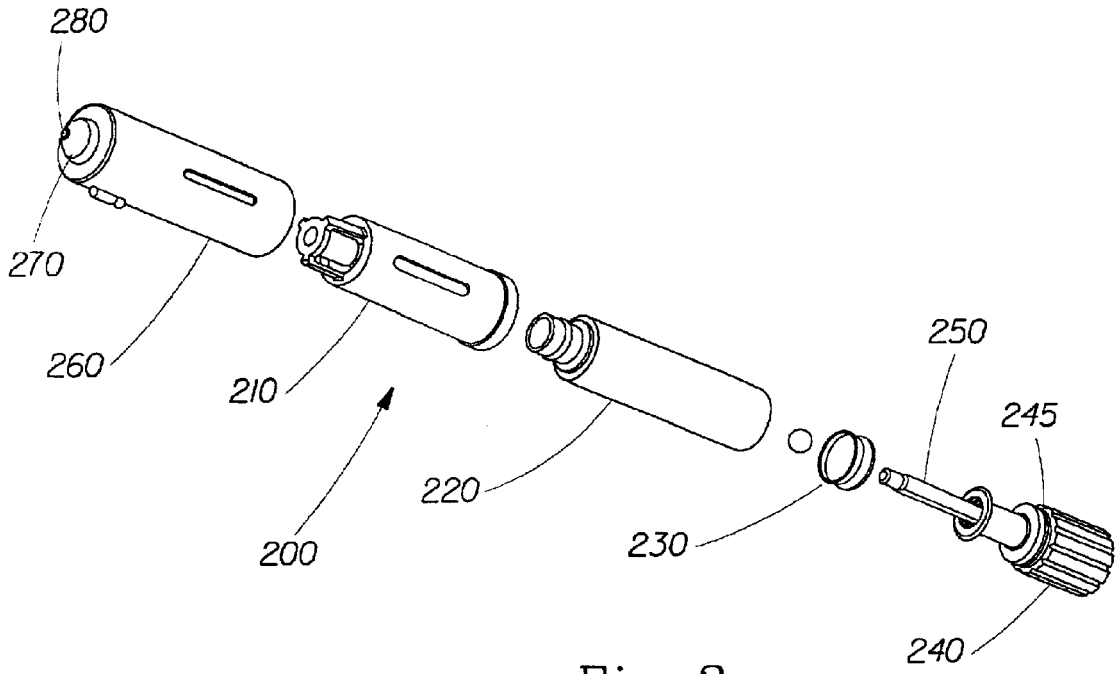
FIG. 3 is an exploded isometric view of the disposable cartridge within FIG. 1.

In a first embodiment of this invention, such as shown in FIG. 3, disposable cartridge 200 has a conductive shield 210 which is positioned substantially around the outer perimeter of product reservoir 220. Conductive shield 210 may be constructed using conductive plastic (e.g. acrylonitrile butadiene styrene (ABS) filled with 10% carbon fibers), metal (e.g. aluminum) or any other suitable material. Conductive shield 210 may be formed as an integral part to cartridge insulator 260, such as through co-injection or two shot molding or any other manufacturing techniques. Alternatively, conductive shield 210 may be formed separately and then later connected to cartridge insulator 260 by any suitable technique, including but not limited to, force fitting. Actuator 240 is located at the non-discharge end of disposable cartridge 200. Actuator 240 may have internal threads for passage of one end of a threaded shaft 250, and a snap bead 245 to snap into an open end of product reservoir 220. The opposite end of threaded shaft 250 can have a piston 230 which moves about. The threaded shaft 250 can thereby connect the piston 230 with actuator 240, such that piston 230 can slide along an inner surface of product reservoir 220, toward a nozzle 270, in response to the turning of actuator 240 by the gearbox/motor component 10. This movement of piston 230 can thus displace product from the product reservoir 220.

Alternatively, the product reservoir 220 may be formed of a conductive material and used to maintain the product reservoir at a high potential instead of having a separate conductive shield around the reservoir 220. A cartridge insulator 260 can prevent discharge from the conductive product reservoir 220 to points having a lower potential that are in close proximity to the product reservoir 220. The product reservoir 220 can be molded of an electrically conductive material plastic such as acrylonitrile butadiene styrene (ABS) filled with 10% carbon fibers. The cartridge insulator 260 provides an insulating cover to prevent discharge from the conductive product reservoir 220 to objects within the device having lower electrical potentials. In this embodiment, the conductive shield 210 is not required.

Figure 4:
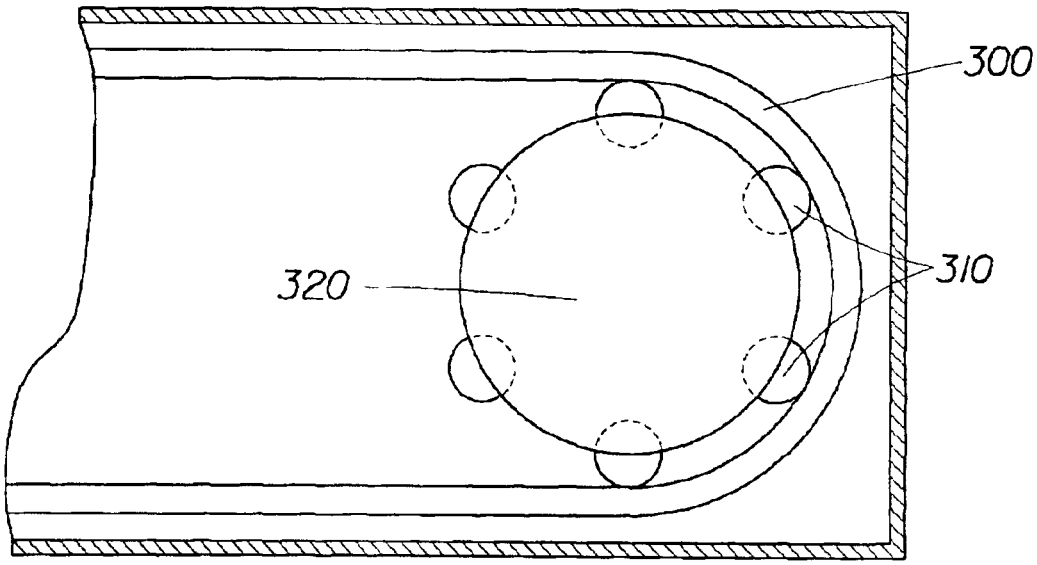
FIG. 4 is a cross-sectional side view of a peristaltic pump.

In another aspect of this invention, the delivery system may prevent the flow of current through the product reservoir 220 by keeping the product located in the charging location of the electrostatic spray device out of fluid communication with the product reservoir. A delivery system such as the peristaltic pump shown in FIG. 4, for example, may be used to physically isolate the product in the charging location from the product reservoir. The peristaltic pump delivers the product by pinching and rolling a delivery tube 300 using multiple rollers 310 as the rollers rotate on a central hub 320. The pinching action of the rollers 310 breaks the fluid communication of the product located in the charging location from the product located in the product reservoir 220. This prevents current from flowing through the product from the charging location to the product reservoir 220.

Figure 5:
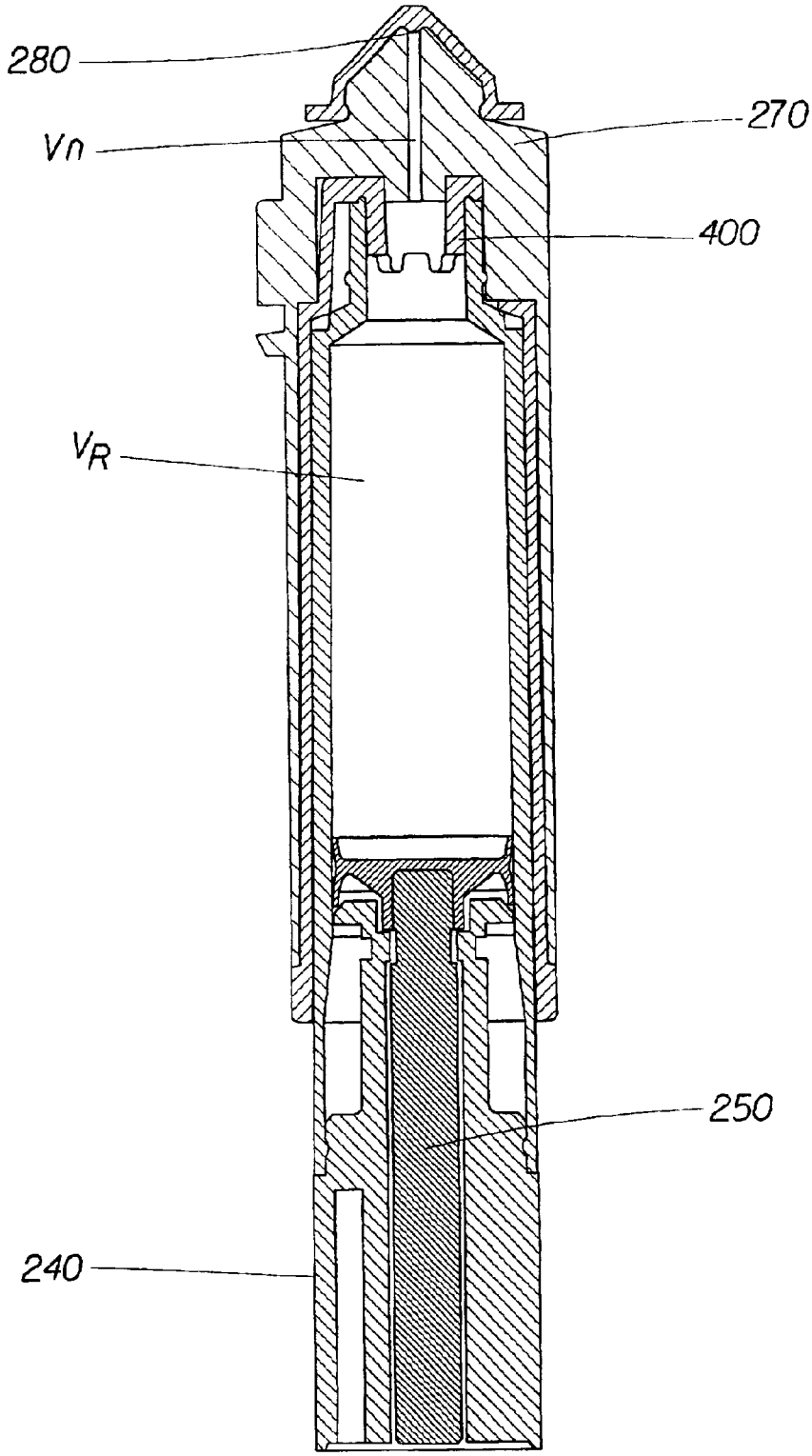
FIG. 5 is a cross-sectional view of one embodiment of a disposable cartridge of the present invention.
Figure 6:
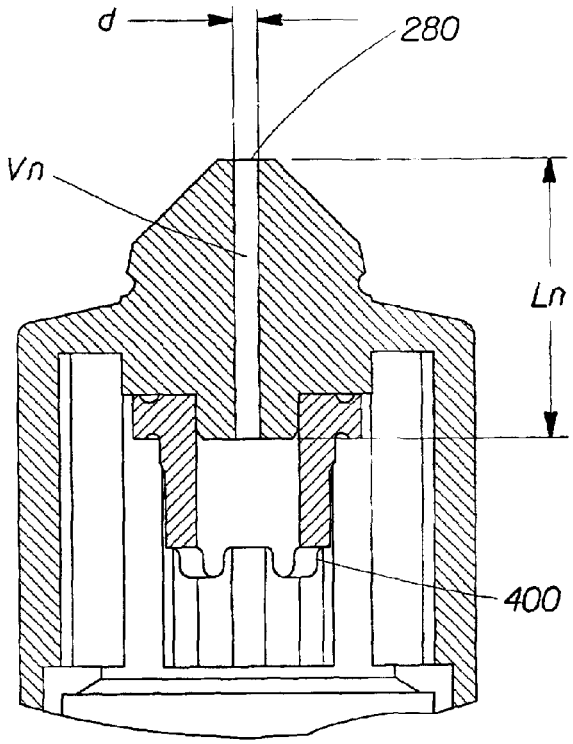
FIG. 6 is a partial cross-sectional view of one embodiment of a disposable cartridge of the present invention.

In yet another aspect of this invention, as shown in FIGS. 5 and 6, the volume of fluid product located between electrode charging location 400 and nozzle exit orifice 280 can be limited. While minimizing the volume between these locations will not eliminate electrically induced product separation, it can minimize its effects on spray quality by containing any electrically induced product separation to a relatively small volume of product. Wishing not to be bound by theory, it is believed that once electrically induced product separation has begun in a volume of product the process will continue over time even after the electrical current is no longer present.

In a first embodiment of this invention where product application times of the product are relatively standard, the percent of the total product that is dispensed during one application that is present between the charging point and the point of the product dispensing from the device, VP, can be expressed by the following formula:

$$VP=(Vn/FR)\times Ta\times 100$$

Where:

Vn=the volume of product between the charging location and point of product dispensing from the device (cm3)

FR=volumetric flowrate (mL/min)

Ta=Time per one application (min)

Preferably, the volume of product located between the charging location and the point of the product dispensing from the device less than about 20% of the volume of the product delivered during one product application. More preferably, this volume is less than about 10% of the volume of the product delivered during one product application, and most preferably less than about 5% of the volume of the product delivered during one product application. In this embodiment, any product separation resulting from exposure to electrical current occurring between the charging location and the point of product dispensing is minimized.

In a second embodiment in which the application time of a product application is not standard, the volume Vn of the product between the charging location and the point of product dispensing from the device can be compared to the overall volume of the product reservoir in order to minimize the effects of any electrically separated product on the overall spray performance. This percentage can be expressed as:

$$Vn/Vr\times 100<10\%$$

Where:

Vn=the volume of product between the charging location and point of product dispensing from the device (cm3)

Vr=the volume of product contained within the product reservoir at full capacity (cm3)

Preferably, the volume of product located between the charging location and the point of the product dispensing from the device less than about 10% of the volume of the product reservoir. More preferably, this volume is less than about 5% of the volume of the product reservoir, and most preferably less than about 1% of the volume of the product reservoir. In this embodiment, any product separation resulting from exposure to electrical current occurring between the charging location and the point of product dispensing is minimized.

Still another aspect of this invention is to define a method for determining a preferred volume of the fluid pathway between the charging location and point of product dispensing from the device. This relationship is applicable for electrostatic spray devices where the fluid pathway between the charging location and point of product dispensing is of a generally cylindrical nature. It has been found that an optimal ratio of length of the fluid pathway to the diameter of the fluid pathway can be characterized by the following relationship:

$$Ln/d>1$$

Where:

Ln=the linear distance between the charging location and point of product dispensing (usually the tip of the nozzle)

d=diameter of the generally cylindrical fluid passageway

This relationship defines a preferred length to diameter relationship. Preferably, this ratio is greater than 1, more preferably the ratio is greater than about 5, and most preferably the ratio is greater than about 10. In this case, the volume of the product directly exposed to electrical current, and thereby the volume of product likely to undergo electrically induced product separation can be minimized.

Figure 7:
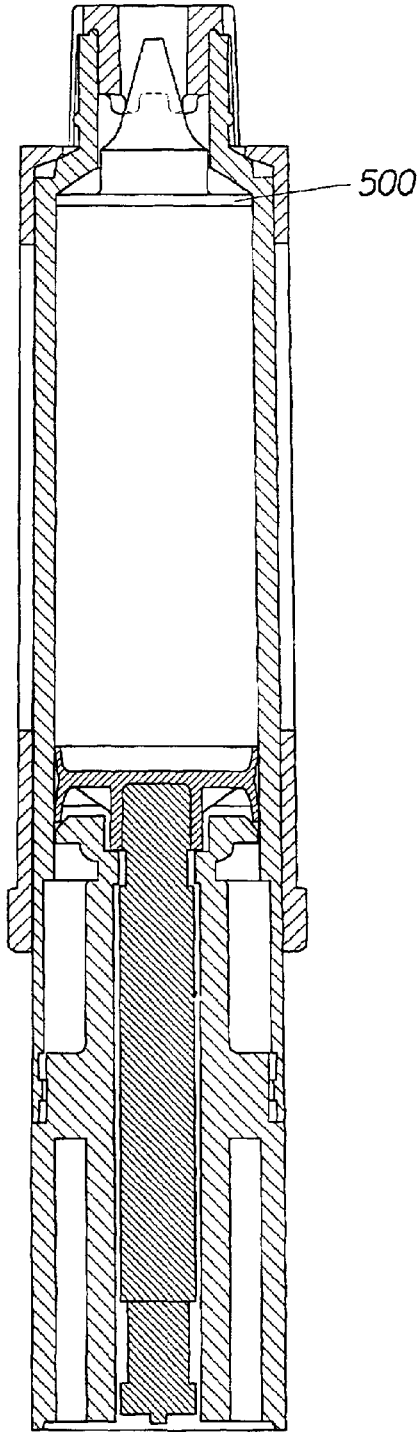
FIG. 7 is a cross-sectional view of one embodiment of a disposable cartridge of the present invention.

In relation to the effects of electrically induced product separation, it has also been learned that once this separation has started, this separation may continue to separate product after the electrical field gradient is removed, the high voltage power is de-energized and the stored device capacitance has been completely drained. It is therefore advantageous to prevent product separation between the charging location and the nozzle orifice (where electrical current is intentionally passed through the product to produce and support the formation of the product atomized spray) from flowing back into the product reservoir. One means to accomplish this is to include a valve, such as a reed or duckbill type valve 500, or a check (one-way) type valve such as shown in FIG. 7. The valve would be to allow product flow in one direction when the product delivery system is active, and then when the product delivery system is not active, the valve would close and prevent backflow (backflow being defined as product between the charging location and the nozzle orifice traveling back into the product reservoir).

In yet another aspect of this invention, reducing the impact of electrically induced product separation on spray performance can be accomplished by purging the fluid located between the charging location and the point of product dispensing after a spraying operation is compete. This purging operation can remove the separated product before the next spraying operation. The purging can be accomplished via the electronic circuitry in the form of a delay switch or timer so that after the operator completes the spraying operation and de-energizes the device, the product delivery means will continue to actuate for a period of time sufficient to purge the volume of fluid between the charging location and the nozzle exit orifice. Therefore the product that has been exposed to electrical current does not mix or is exposed to product from the product reservoir that has not been exposed to such an electrical current. In this manner, when the operator is ready for the next application, the fluid between the charging location and the nozzle tip will be not have been exposed to electrical current. In this embodiment, the purging circuit is designed such that when the delivery means is operating to purge the fluid the circuitry to generate the high voltage generating circuitry is not operating. Alternatively, the purging operation could be performed prior to a spraying operation instead of after a spraying operation.

Figure 8:
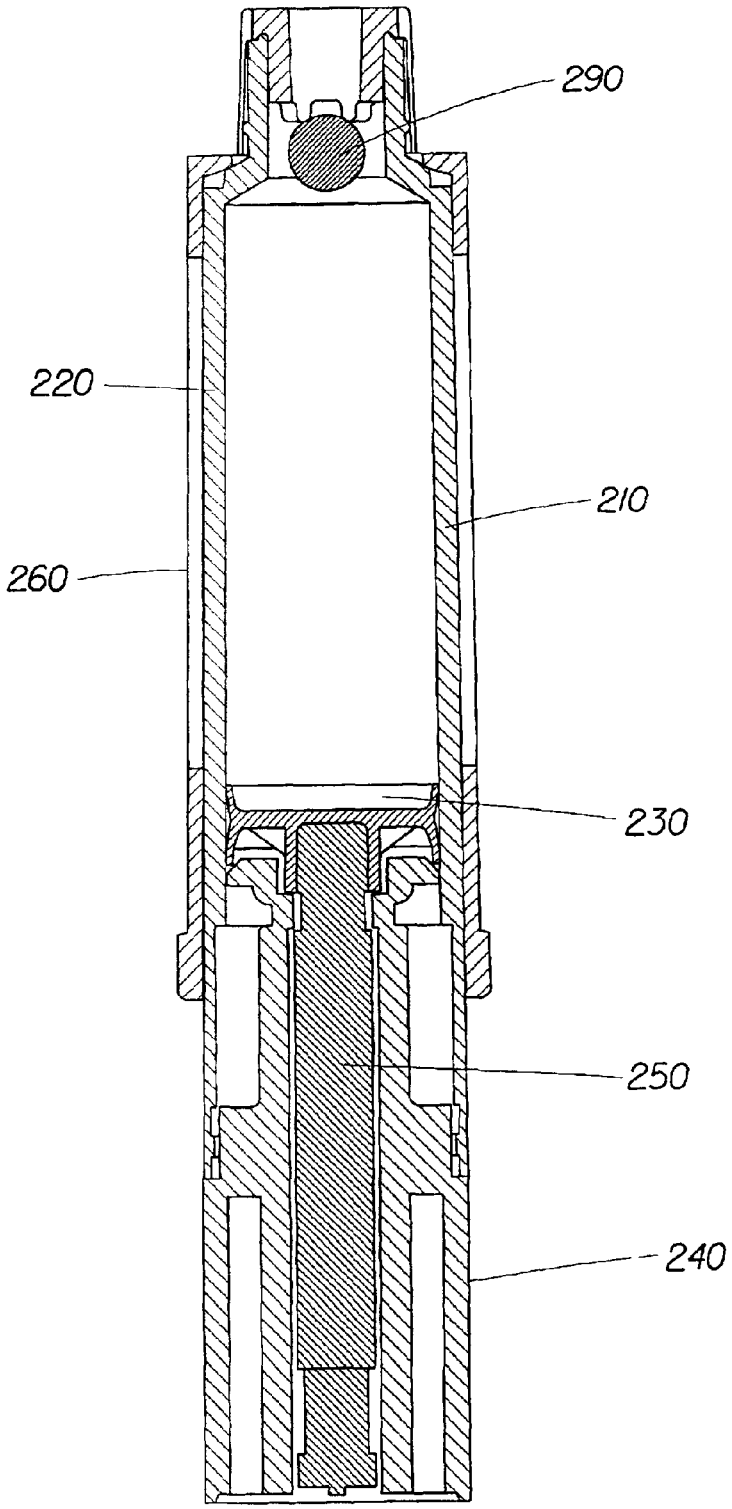
FIG. 8 is a cross-sectional view of one embodiment of a disposable cartridge of the present invention.

Yet another aspect of this invention relates to a means of mechanically mixing and re-suspending separated material within either product reservoir 220 or within the subsequent product delivery pathway. In a first embodiment, as exampled in FIG. 8, one or more mixing balls 290 are placed within product reservoir 220. Disposable cartridge 200 is then shaken by the operator which causes mixing ball 290 to move within product reservoir 220. The movement of mixing ball 290 within product reservoir 220 achieves turbulent mixing of the product within product reservoir 220, thereby reconstituting any separated product. It may be appreciated that the shaking of disposable cartridge 200 may occur while it is either inside or outside of the intended electrostatic spraying device.

Figure 9:
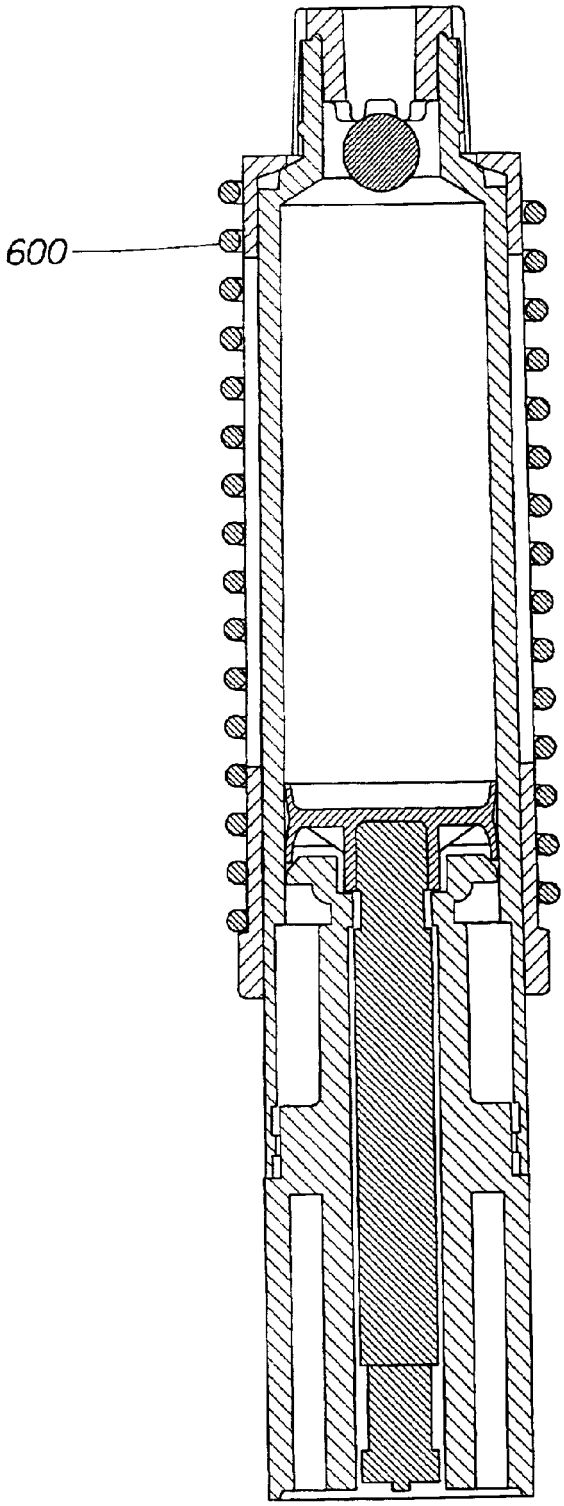
FIG. 9 is a cross-sectional view of one embodiment of a disposable cartridge of the present invention.

Another embodiment provided with mixing balls includes an electrically activated mixing system supplied in the device such as shown in FIG. 9. In this example, the electrically activated mixing system includes a series of wire coils 600 positioned substantially around the perimeter of the product reservoir 220. By passing alternating currents through the wire coils 600, changes in the electric field between wire coils 600 cause movement of one or more mixing balls 290 within the product reservoir 220. The movement of the one or more mixing balls 290 within product reservoir 220 can achieve turbulent mixing of product within product reservoir 220, thereby reconstituting separated product. Yet another embodiment that would provide for mixing within product reservoir 220 includes a vibrating mechanism. A vibrating mechanism can be placed in fluid communication with the product reservoir 220. The vibratory action of the vibrating mechanism can generate turbulent mixing within product reservoir 220 and can reconstitute separated product.

Figure 10:
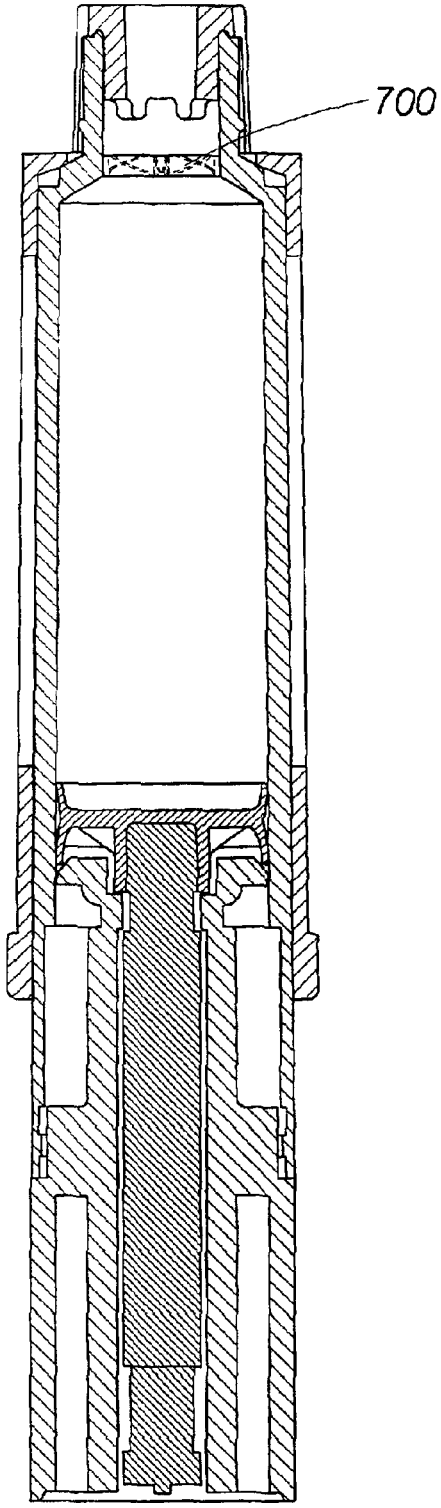
FIG. 10 is a cross-sectional view of one embodiment of a disposable cartridge of the present invention.
Figure 11:
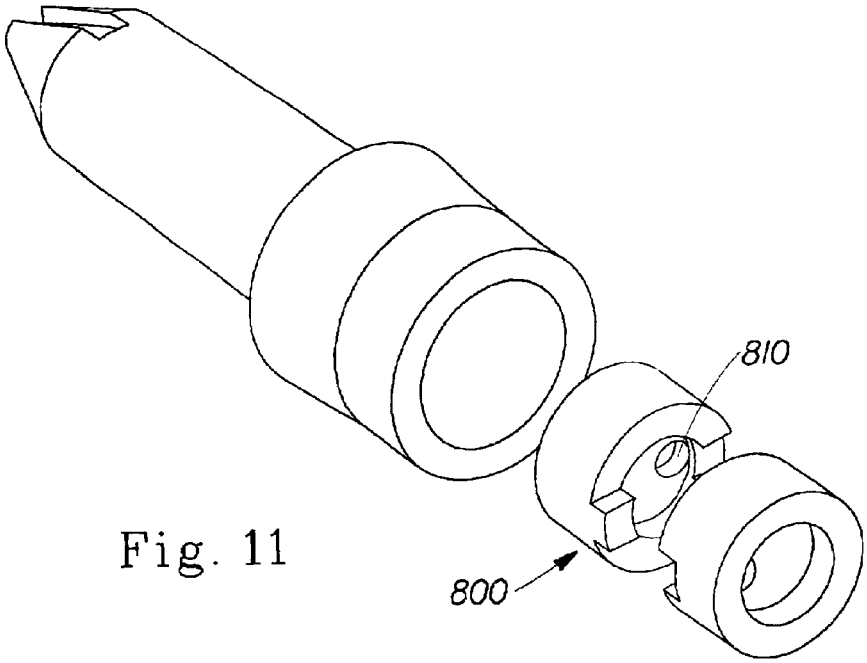
FIG. 11 is an isometric view of a disposable cartridge having at least one disc for increasing turbulent mixing.
Figure 12:
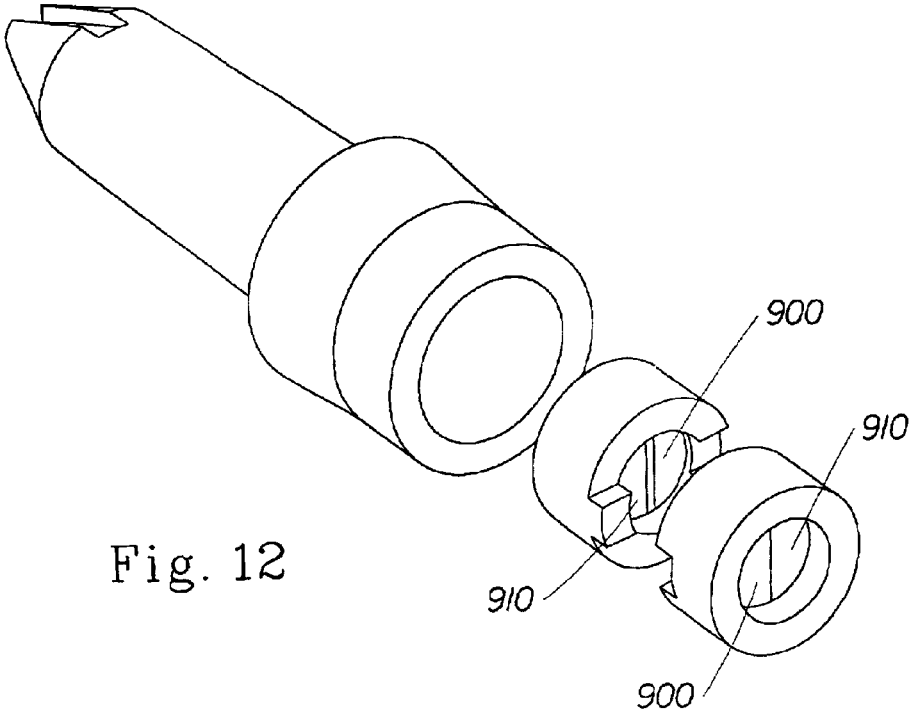
FIG. 12 is an isometric view of a disposable cartridge having at least one baffle for increasing turbulent mixing.

In yet another embodiment that provides for product mixing, as exampled in FIG. 10, a static mixer 700 is placed in fluid communication between product reservoir 220 and nozzle exit orifice 280. Static mixer 700 is designed such that it creates a high degree of turbulent mixing within the fluid flow path in comparison to a straight fluid flow path. The turbulent mixing achieved within the fluid flow path should reconstitute any separated product. Static mixers 700 include, but are not limited to,:

1. a helical type structure, as exampled in FIG. 10, although other geometries may be appreciated;
2. at least one disc 800, as exampled in FIG. 11, having at least one hole 810. Disc 800 being inserted within the product flow path. A plurality of discs 800 may be inserted, and more preferably with their holes 810 not being in axial alignment in order to increase turbulent mixing. It may be appreciated that one skilled in the art may change the diameter of holes 810, the location of holes 810, and/or the number of holes 810 in order to alter the degree of turbulent mixing. The diameter of hole 810 in the embodiment of FIG. 11 is approximately 0.030" diameter.
3. at least one baffle 900, as exampled in FIG. 13, having a series of openings 910. Baffle 900 being inserted within the product flow path. A plurality of baffles 900 may be inserted, more preferably with their openings 910 not being in axial alignment in order to increase turbulent mixing. It may be appreciated that one skilled in the art may change the change the size of baffles 910, the location of baffles 910, and/or the number of baffles 910 in order to alter the degree of turbulent mixing.

Figure 13:
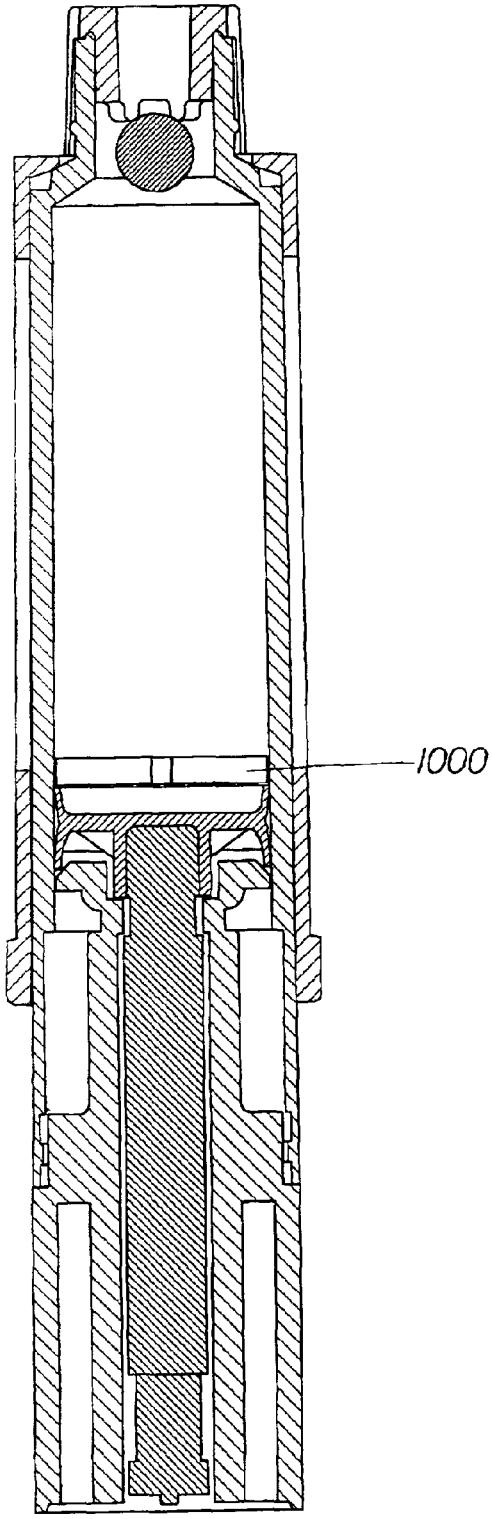
FIG. 13 is a cross-sectional view of a disposable cartridge having a prop mixer.

In yet another embodiment, as exampled in FIG. 13, a prop mixer 1000 is added within product reservoir 220 in order to provide product mixing. Prop mixer 1000 may take the form of a paddle connected to piston 230. As piston 230 rotates up or down, so does prop mixer 1000, thereby creating turbulent mixing within product reservoir 220. One skilled in the art may also appreciated that the prop mixer 1000 need not necessarily be attached to a piston 230. Such alternative configurations include, but are not limited to:

1. prop mixer 1000 being attached to another rotating member (e.g. threaded shaft 250) within either the product reservoir 220 or subsequent product delivery pathway; or
1. prop mixer 1000 not being attached but rather contained in a manner so as to allow prop mixer 1000 to rotate about a longitudinal axis in response to fluid flow.

Having shown and described the preferred embodiments of the present invention, further adaptions of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the present invention have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

INCORPORATION BY REFERENCE

Relevant electrostatic spray devices and cartridges are described in the following commonly-assigned, concurrently-filed U.S. Patent Applications, and hereby incorporated by reference:

"Electrostatic Spray Device".

"Electrostatic Spray Device".

"Disposable Cartridge For Electrostatic Spray Device".

What is claimed is:

1. An electrostatic spraying device being configured and disposed to electrostatically charge and dispense a product from a supply to a point of dispersal, wherein said device comprises:

a reservoir configured to contain the supply of product;

a nozzle to disperse the product, said nozzle being disposed at the point of dispersal; said nozzle having an exit orifice;

a channel disposed between said reservoir and said nozzle, wherein said channel, permits the electrostatic charging of the product upon said product moving within said channel;

a power source to supply an electrical charge;

a high voltage power supply, said high voltage power supply being electrically connected to said power source;

a high voltage electrode, said high voltage electrode being electrically connected to said high voltage power supply, a portion of said high voltage electrode being disposed between said reservoir and said nozzle, said high voltage electrode electrostatically charges the product within said channel at a charging location; and a high voltage shield substantially wounding said reservoir, said high voltage shield being conductive.

2. The electrostatic spraying device of claim 1, wherein said high voltage shield is selected from one of the group consisting of: a conductive plastic high voltage shield and a metal high voltage shield.

3. The electrostatic spraying device of claim 1, wherein said high voltage shield is an integral part of the reservoir.

4. The electrostatic spraying device of claim 3, wherein said reservoir is part of a removable cartridge.

5. The electrostatic spraying device of claim 1, further comprising a valve for preventing backflow into said reservoir.

6. The electrostatic spraying device of claim 1, wherein said high voltage shield forms a wall of said reservoir.

7. A cartridge configured to contain and deliver a product for use with an electrostatic spray device comprising:

a reservoir configured to contain the product;

a nozzle to disperse the product, said nozzle having an exit orifice;

a channel disposed between said reservoir and said nozzle, wherein said channel permits the electrostatic charging of the product upon said product moving within said channel;

a high voltage, contact for receiving power from the electrostatic device;

a high voltage electrode electrically connected to said high voltage contact, said high voltage electrode being configured to charge the product for dispersal from said nozzle; and a high voltage shield substantially surrounding said reservoir, said high voltage shield being conductive.

8. The cartridge of claim 7, wherein said high voltage shield is selected from one of the group consisting of: a conductive plastic high voltage shield and a metal high voltage shield.

9. The cartridge of claim 7, wherein said high voltage shield is an integral part of the reservoir.

10. The cartridge of claim 7, further comprising a valve for preventing backflow into said reservoir.

11. The electrostatic spraying device of claim 7, wherein said high voltage shield forms a wall of said reservoir.

* * * * *